US008167562B2

(12) United States Patent
Sakai et al.

(10) Patent No.: US 8,167,562 B2
(45) Date of Patent: May 1, 2012

(54) CENTRIFUGAL FAN AND BLOWER HAVING THE SAME

(75) Inventors: Masaharu Sakai, Obu (JP); Yoshiki Kondo, Nishio (JP); Toshinori Ochiai, Obu (JP); Tomonori Akatsuka, Nishio (JP)

(73) Assignee: Denso Corporation, Kariya (JP)

( * ) Notice: Subject to any disclaimer, the term of this patent is extended or adjusted under 35 U.S.C. 154(b) by 978 days.

(21) Appl. No.: 12/215,669

(22) Filed: Jun. 27, 2008

(65) Prior Publication Data

US 2009/0004007 A1 Jan. 1, 2009

(30) Foreign Application Priority Data

Jun. 29, 2007 (JP) ..... 2007-171520
Dec. 26, 2007 (JP) ..... 2007-334107

(51) Int. Cl.
*F03B 3/12* (2006.01)

(52) U.S. Cl. ..... 416/178; 416/187

(58) Field of Classification Search ..... 416/177, 416/181, 182, 190
See application file for complete search history.

(56) References Cited

U.S. PATENT DOCUMENTS 6,007,300 A * 12/1999 Saeki et al. ..... 416/178

FOREIGN PATENT DOCUMENTS

| | | |
|---|---|---|
| JP | 48-37286 | 11/1973 |
| JP | 60-73095 | 4/1985 |
| JP | 62-107296 | 5/1987 |
| JP | 7-158593 | 6/1995 |
| JP | 2004-270579 | 9/2004 |
| JP | 2005-351141 | 12/2005 |

OTHER PUBLICATIONS

Office action dated Jul. 7, 2009 in corresponding Japanese Application No. 2007-334107.

* cited by examiner

*Primary Examiner* — Cheung Lee
(74) *Attorney, Agent, or Firm* — Harness, Dickey & Pierce, PLC

(57) ABSTRACT

A centrifugal fan includes a plurality of blades, a first wall disposed at first axial ends of the blades, and a second wall disposed at second axial ends of the blades and having a shaft portion at a center. At least one of the first wall and the second wall has a cutout portion configured to control balance.

10 Claims, 10 Drawing Sheets

CENTRIFUGAL FAN AND BLOWER HAVING THE SAME

CROSS REFERENCE TO RELATED APPLICATION

This application is based on Japanese Patent Applications No. 2007-171520 filed on Jun. 29, 2007 and No. 2007-334107 filed on Dec. 26, 2007 the disclosure of which are incorporated herein by reference.

FIELD OF THE INVENTION

The present invention relates to a centrifugal fan and a blower having the same, which is, for example, used for a vehicle air conditioning apparatus.

BACKGROUND OF THE INVENTION

In a conventional blower, it is known to control balance of a fan so as to cancel vibrations between the fan and a motor as rotational members. The balance is controlled by adding a balance weight to the fan or reducing an excess weight from the fan. Controlling the balance by adding the balance weight is, for example, referred to as a plus balance control, and controlling the balance by reducing the excess weight is, for example, referred to as a minus balance control.

In general, the minus balance control is put into practice at a relatively low cost because the balance weight needs not to be added. As an example of the minus balance control, if a cutout portion is formed on a fan blade, which serves to force air out, air flow will be disturbed by the cutout portion. As a result, air blowing efficiency will be reduced and noise will be increased.

SUMMARY OF THE INVENTION

The present invention is made in view of the foregoing matter, and it is an object of the present invention to provide a centrifugal fan having a structure of a minus balance control, capable of suppressing a decrease in air blowing efficiency and an increase in noise. It is another object of the present invention to provide a blower having a centrifugal fan having a structure of a minus balance control, capable of suppressing a decrease in air blowing efficiency and an increase in noise.

According to a first aspect of the present invention, a centrifugal fan includes a plurality of blades, a first wall disposed at first axial ends of the blades, and a second wall disposed at second axial ends of the blades and having a shaft portion at a center. The first wall has a cutout portion configured to control balance.

Accordingly, the balance is controlled by the cutout portion formed on the first wall. That is, the balance is controlled without cutting a portion of the blade, which serves to force air out. Therefore, it is less likely that air blowing efficiency will be reduced and noise will be increased due to the cutout portion.

According to a second aspect of the present invention, a centrifugal fan includes a plurality of blades, a first wall disposed at first axial ends of the blades, and a second wall disposed at second axial ends of the blades and having a shaft portion at a center. The second wall has a cutout portion configured to control balance.

Accordingly, the balance is controlled by the cutout portion formed on the second wall. That is, the balance is controlled without cutting a portion of the blade, which serves to force air out. Therefore, it is less likely that air blowing efficiency will be reduced and noise will be increased due to the cutout portion.

For example, the centrifugal fan is employed to a blower and is housed in a casing. In a case where the first wall of the centrifugal fan has a first projection that projects from the first axial ends of the blades toward a bell mouth portion of the casing to form a labyrinth-like structure between the bell mouth portion and the first wall, the cutout portion can be formed on the first projection. As another example, in a case where the centrifugal fan has a second projection that projects from the first wall or the second wall in a radially outward direction toward the air passage of the casing for facilitating generation of rotational flow of air in the casing, the cutout portion can be formed on the second projection. As further another example, in a case where the second wall of the centrifugal fan has a projection that projects from the second axial ends of the blades in an axially outward direction and forms a labyrinth-like structure with the casing, the cutout portion can be formed on the projection. Accordingly, the cutout portion is formed on the portion other than blades, and will not directly interfere with air flow path.

BRIEF DESCRIPTION OF THE DRAWINGS

Other objects, features and advantages of the present invention will become more apparent from the following detailed description made with reference to the accompanying drawings, in which like components are designated by like reference characters and in which.

DETAILED DESCRIPTION OF EXEMPLARY EMBODIMENTS

Figure 1:
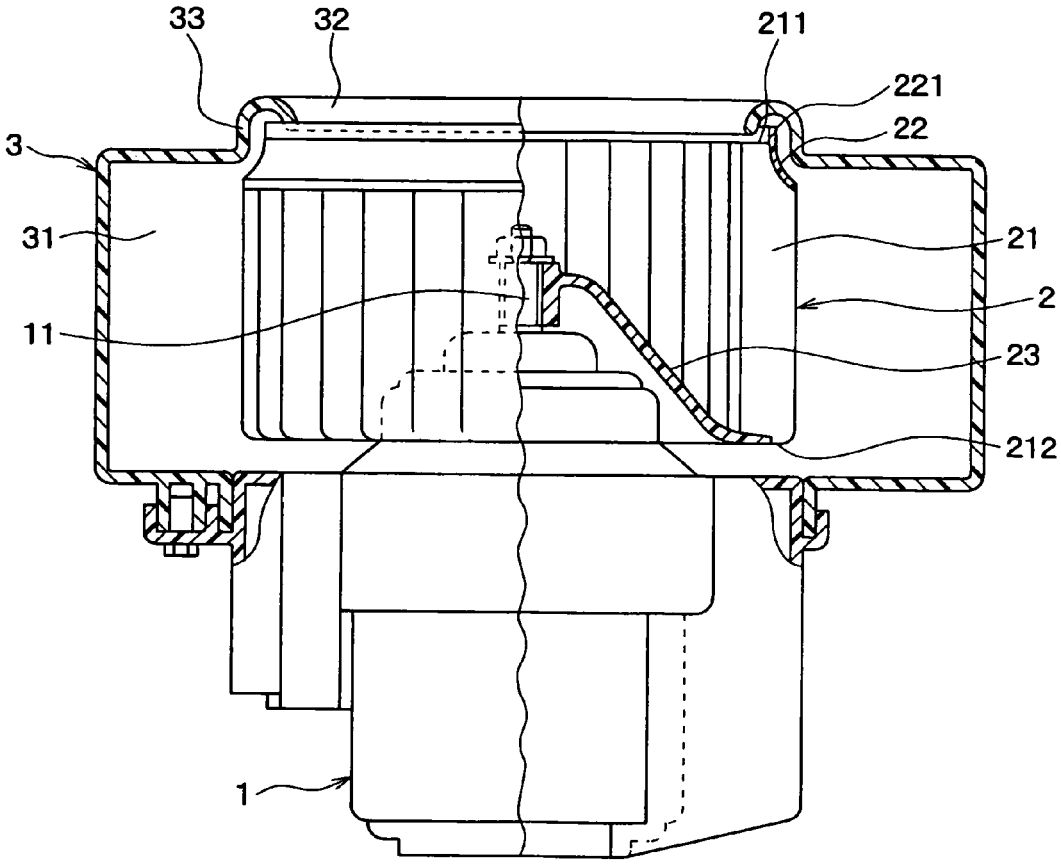
FIG. 1 is a schematic cross-sectional view of a blower having a centrifugal fan according to a first embodiment of the present invention.

Exemplary embodiments of the present invention will now be described with reference to the accompanying drawings. Hereinafter, like components are designated by like reference characters, and a description thereof is not repeated.

First Embodiment

Figure 2:
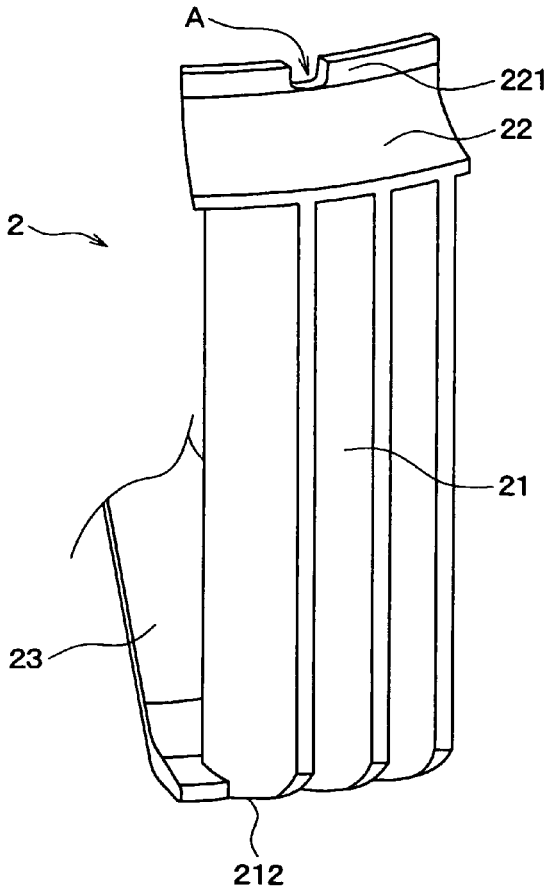
FIG. 2 is a perspective view of a part of the centrifugal fan shown in FIG. 1.

Referring to FIGS. 1 and 2, a blower generally has an electric motor 1, a centrifugal fan (hereinafter, simply referred to as the fan) 2, and a scroll casing (hereinafter, simply referred to as the casing) 3. The electric motor 1 has a rotation shat 11. The fan 2 is made of a resin and is housed in the casing 3. The fan 2 is driven by the electric motor 1 to generate air. The casing 3 is made of a resin, and has a scroll passage 31 through which the air generated by the fan 2 flows.

The casing 3 has a suction port 32 at a first axial end. The suction port 32 is open in an axial direction of the fan 2. Further, the casing 3 has a bell-mouth 33 on a perimeter of the suction port 32. The bell-mouth 33 extends toward an inner periphery of the fan 2 for conducting air from the suction port 32 into the fan 2.

The fan 2 has a plurality of blades 21, a side wall 22, and a main wall 23. The blades 21 are arranged on a periphery of the rotation shaft 11. The blades 21, for example, have a plate shape. The side wall 22 has an annular shape. First axial ends 211 of the blades 21, which are closer to the suction port 32, connect to the side wall 22, and second axial ends 212 of the blades 21, which are further from the suction port 32, connect to the main wall 23. In other words, the first axial ends 211 of the blades 21 are connected to each other through the side wall 22, and the second axial ends 212 of the blades 21 are connected to each other through the main wall 23. The side wall 22 is located adjacent to the suction port 32 of the casing 3. The main wall 23 is located further than the side wall 22 with respect to the suction port 32 in the axial direction.

The main wall 23 connects to the rotation shaft 11 at its center. That is, the main wall 23 has a shaft portion to be coupled to the rotation shaft 11 at the center thereof. A driving force of the electric motor 1 is transmitted to the fan 2 through the rotation shaft 11 and the main wall 23. As driven by the electric motor 1, the fan 2 suctions air from its first axial end in the axial direction and blows the air in a radial direction of the fan 2, which is perpendicular to an axis of the rotation shaft 11.

The side wall 22 has an aerodynamic cross-sectional shape for facilitating the air flow between the blades 21. The side wall 22 has a cross-sectional shape such that a cross-sectional area of an air passage between the blades 21 reduces from an inner side toward an outer side with respect to the radial direction. For example, the side wall 22 has a substantially arc shape in a cross-section.

The side wall 22 has a side-wall first projection 221. The side-wall first projection 221 has an annular shape and projects from the first axial ends 211 of the blades 21 in an axially outward direction. For example, the side-wall first projection 221 has a cylindrical shape that is coaxial with the rotation shaft 11. The fan 2 is housed in the casing 3 such that the side-wall first projection 221 is disposed in or adjoined with the bell-mouth 33 of the casing 3. As such, a labyrinth-like structure, such as a maze-shaped clearance is provided between the side-wall first projection 221 and the bell-mouth 33. The labyrinth-like structure restricts the air blown by the fan 2 from flowing back toward the suction port 32 through the clearance between the bell-mouth 33 and the side wall 22.

To cancel vibrations between the electric motor 1 and the fan 2 as the rotational members, that is, to control the balance of the fan, the side-wall first projection 221 has a cutout portion A at a part, as a balance control structure, as shown in FIG. 2. For example, the cutout portion A is provided by partly recessing an axial end of the side-wall first projection 221.

In this case, the balance can be controlled without forming cutout portions on the blades 21, which serves to force the air out. That is, the cutout portion A as the balance control structure is formed at a position without directly interfering with an air flow path. Thus, it is less likely that air-blowing efficiency will be reduced and noise will be increased due to the balance control structure.

The balance control structure is achieved by using the side-wall first projection 221, which is provided for restricting the backflow of the air toward the suction port 32. Thus, it is easy to control the balance without largely changing the shape of the fan 2 and the like.

Second Embodiment

Figure 4:
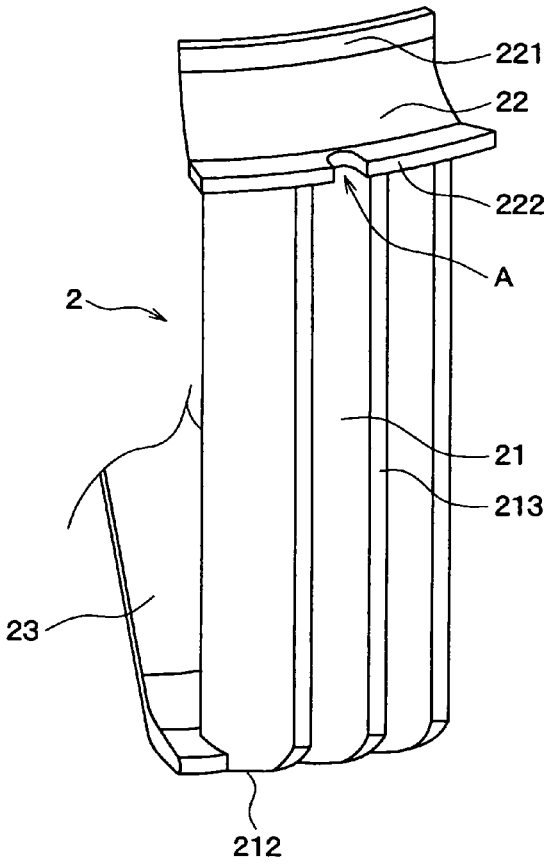
FIG. 4 is a perspective view of a part of the centrifugal fan shown in FIG. 3.
Figure 3:
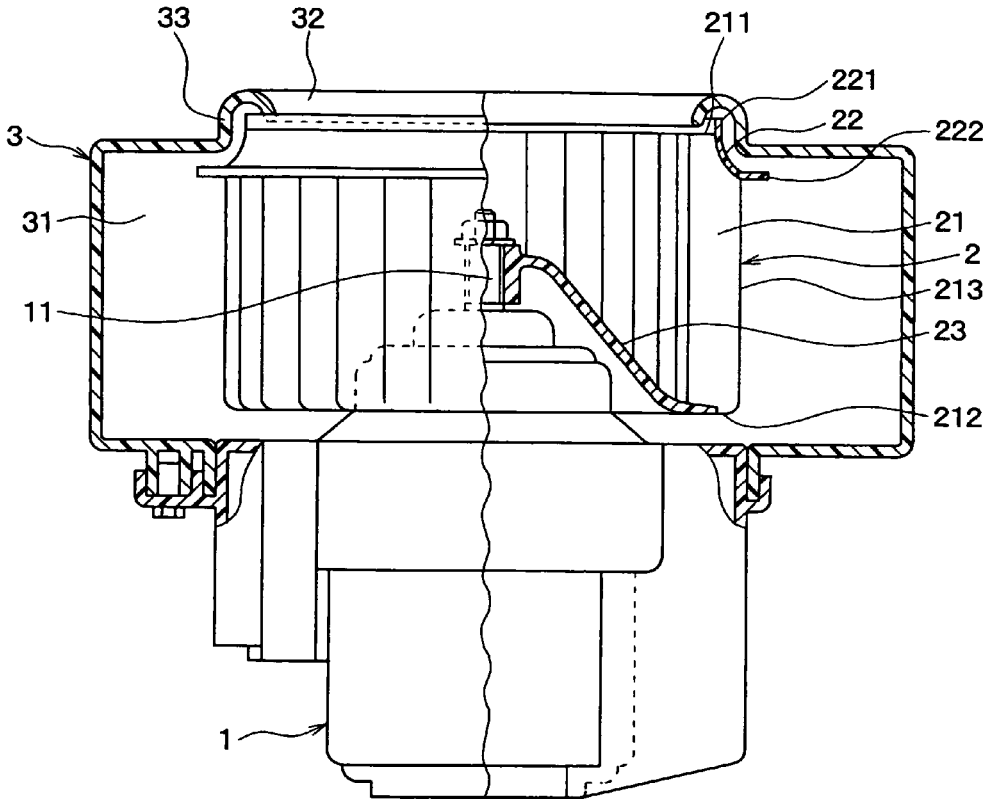
FIG. 3 is a schematic cross-sectional view of a blower having a centrifugal fan according to a second embodiment of the present invention.

Referring to FIGS. 3 and 4, in the fan 2 of the present embodiment, the side wall 22 has a side-wall second projection 222. The side-wall second projection 222 projects from radially outer ends 213 of the blades 21 in a radially outside direction and has an annular shape. For example, the side-wall second projection 222 has a flange shape being generally flat and extending in a direction perpendicular to the axis of the rotation shaft 11, that is, in the radial direction. Further, the side-wall second projection 222 is configured to facilitate generation of a rotational flow of the air in the casing 3.

In the present embodiment, the balance control structure is provided by forming the cutout portion A at a part of the side-wall second projection 222, as shown in FIG. 4. For example, the cutout portion A is provided by partly recessing a radially outer edge of the side-wall second projection 222. In this case, the balance control structure is achieved without forming the cutout portions on the blades 21, which serve to force the air out. It is less likely that the air-blowing efficiency will be reduced and the noise will be increased due to the balance control structure.

The balance control structure is achieved by using the side-wall second projection 222 that is provided for facilitating the rotational flow of the air in the casing 3. It is easy to control the balance without largely changing the shape of the fan 2 and the like.

Third Embodiment

Figure 5:
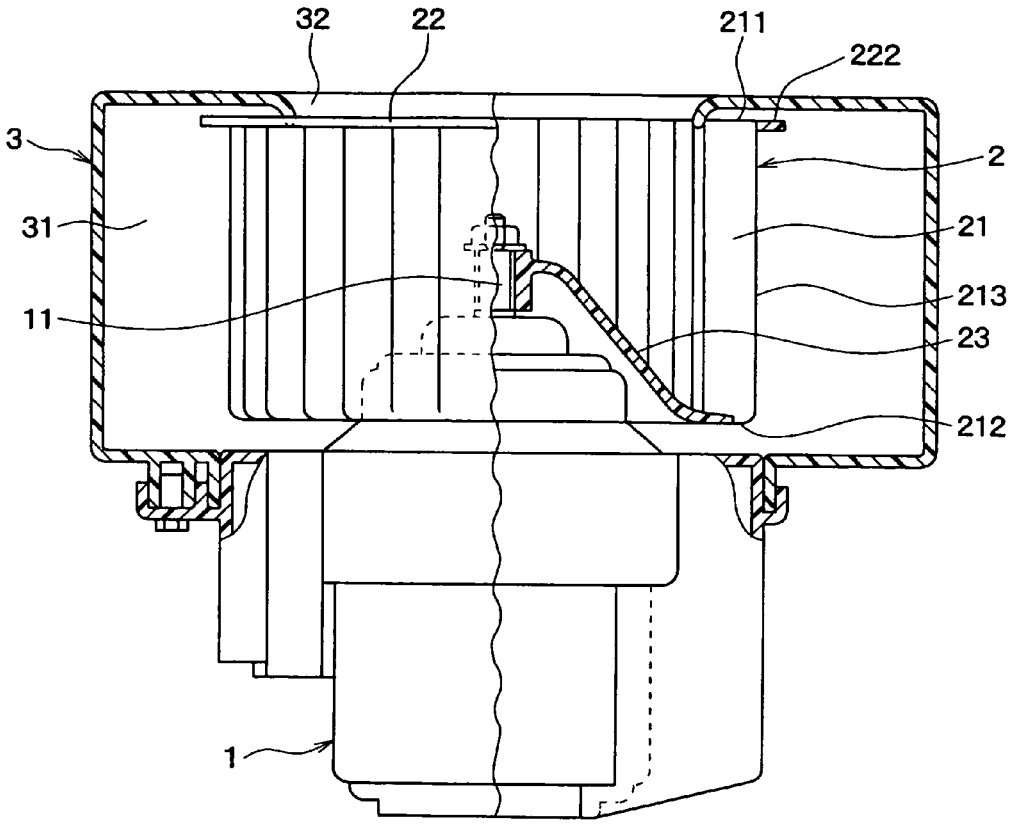
FIG. 5 is a schematic cross-sectional view of a blower having a centrifugal fan according to a third embodiment of the present invention.
Figure 6:
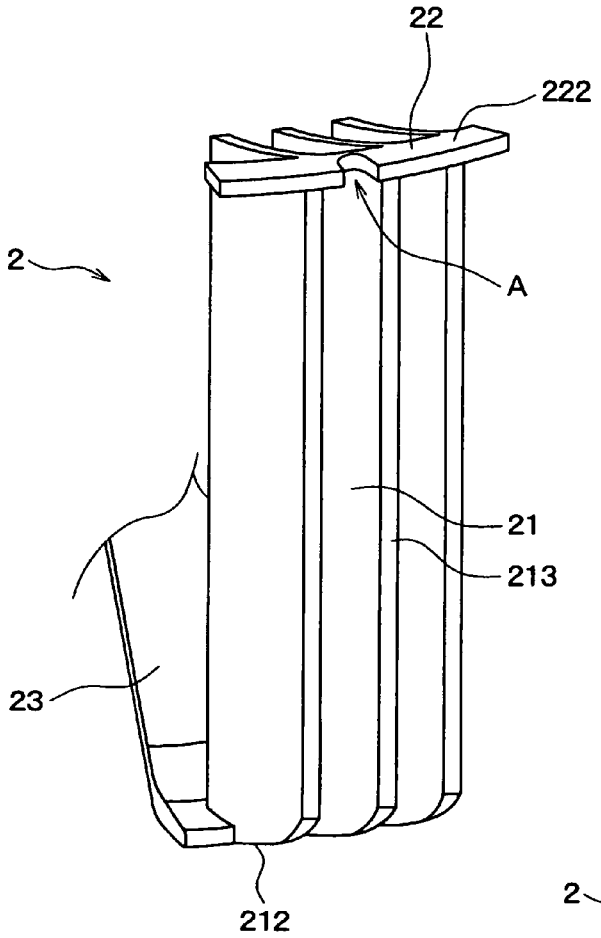
FIG. 6 is a perspective view of a part of the centrifugal fan shown in FIG. 5.

Referring to FIGS. 5 and 6, in the fan 2 of the present embodiment, an entirety of the side wall 22 has a flange shape that is substantially flat and extends in the radial direction. The side wall 22 has the side-wall second projection 222 that projects from the radially outer ends 213 of the blades 21 in the radially outside direction. The side-wall second projection 222 serves to facilitate the generation of the rotational flow of the air in the casing 3.

In the present embodiment, the balance control structure is provided by the cutout portion A formed on a part of the side-wall second projection 222, as shown in FIG. 6. For example, the cutout portion A is provided by recessing a part of the side-wall second projection 222. In this case, the balance control structure is achieved without forming the cutout portions on the blades 21, which serve to force the air out. It is less likely that the air-blowing efficiency will be reduced and the noise will be increased due to the balance control structure.

The balance control structure is achieved by using the side-wall second projection 222 that is provided for facilitating the rotational flow of the air in the casing 3. It is easy to control the balance without largely changing the shape of the fan 2 and the like.

Fourth Embodiment

Figure 8:
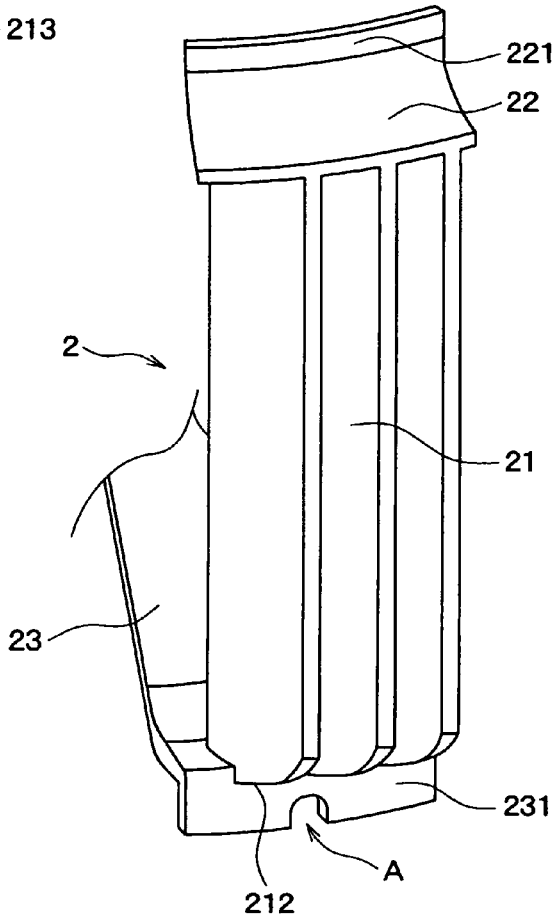
FIG. 8 is a perspective view of a part of the centrifugal fan shown in FIG. 7.
Figure 7:
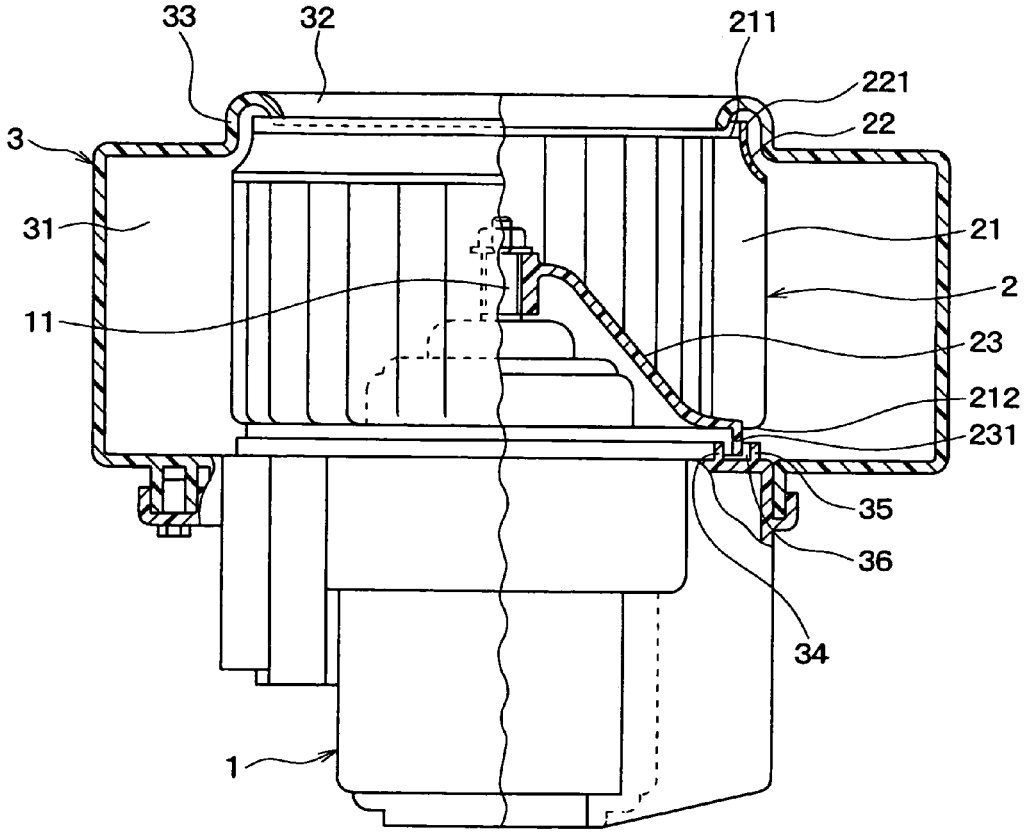
FIG. 7 is a schematic cross-sectional view of a blower having a centrifugal fan according to a fourth embodiment of the present invention.

Referring to FIGS. 7 and 8, in the fan 2 of the present embodiment, the balance control structure is provided by using the main wall 23.

The main wall 23 has a main-wall first projection 231 that projects from the second axial ends 212 of the blades 21 in the axially outward direction and has an annular shape. For example, the main-wall first projection 231 has a cylindrical shape that is coaxial with the rotation shaft 11.

The casing 3 has a casing inner projection 34 and a casing outer projection 35. The casing inner projection 34 and the casing outer projection 35 project from a surface of the casing 3 in the axial direction, the surface facing the main-wall first projection 231. The casing inner projection 34 and the casing outer projection 35 have a cylindrical shape that is coaxial with the rotation shaft 11. The casing inner projection 34 is located on an inner side of the casing outer projection 35 with respect to the radial direction, and is coaxial with the casing outer projection 35. Thus, an annular groove 36 is provided between the casing inner projection 34 and the casing outer projection 35.

The main-wall first projection 231 is disposed in the annular groove 36 such that a labyrinth-like structure, such as a maze-shaped clearance is provided between the casing inner projection 34, the casing outer projection 35 and the main-wall first projection 231. The labyrinth-like structure restricts the air from passing through a clearance between the casing 3 and the main wall 23 of the fan 2.

In the present embodiment, the balance control structure is provided by the cutout portion A formed on a part of the main-wall first projection 231, as shown in FIG. 8. For example, the cutout portion A is provided by partly recessing an axial end of the main-wall first projection 231. In this case, since the balance control structure is provided without forming the cutout portions on the blades 21, which serve to force the air out, it is less likely that the air-blowing efficiency will be reduced and the noise will be increased due to the balance control structure.

The balance control structure is provided by using the main-wall first projection 231 that is provided for restricting the air from passing through the casing 3 and the main wall 23 of the fan 2. It is easy to control the balance without largely changing the shape of the fan 2 and the like.

Fifth Embodiment

Figure 9:
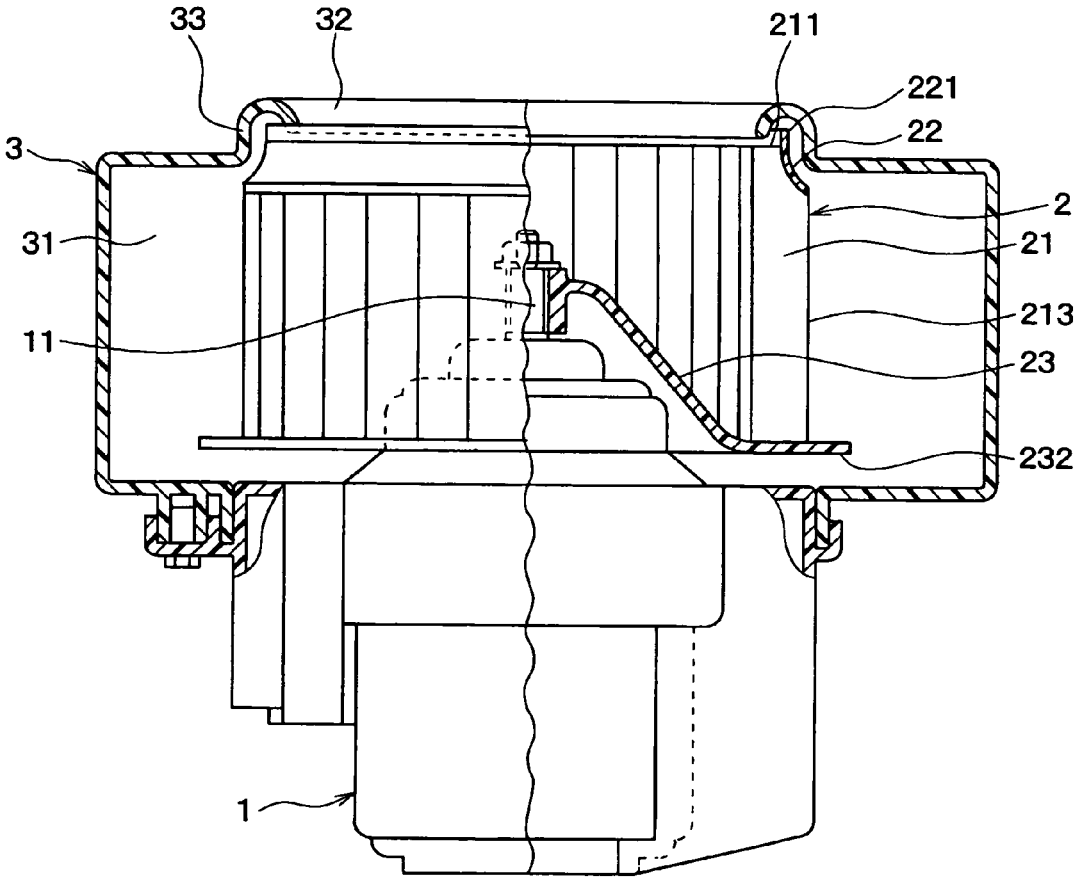
FIG. 9 is a schematic cross-sectional view of a blower having a centrifugal fan according to a fifth embodiment of the present invention.
Figure 10:
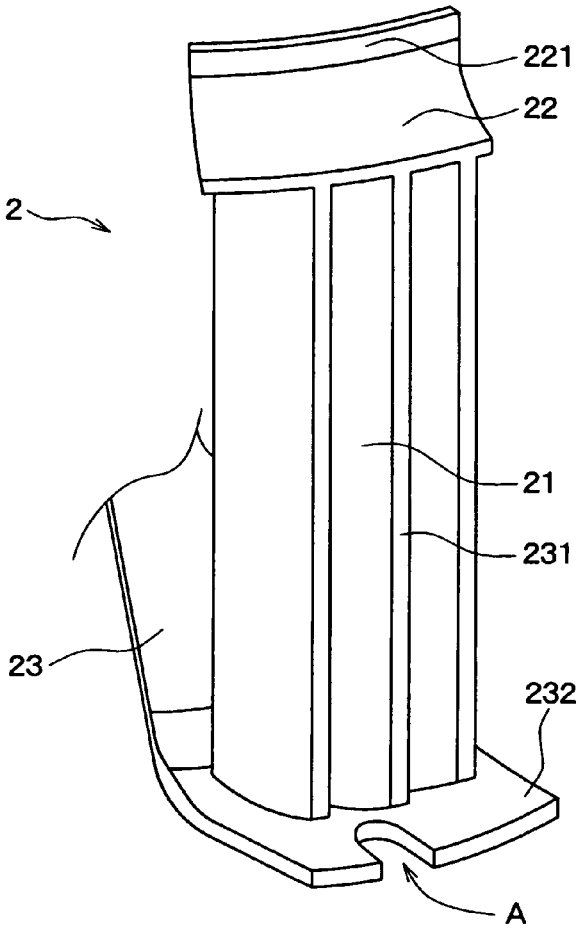
FIG. 10 is a perspective view of a part of the centrifugal fan shown in FIG. 9.

Referring to FIGS. 9 and 10, in the fan 2 of the present embodiment, the main wall 23 has a main-wall second projection 232 that projects from radially outer edges 213 of the blades 21 in the radially outward direction. The main-wall second projection 232 has an annular shape. For example, the main-wall second projection 232 has a flange shape being generally flat and extending in the radially outward direction. The main-wall second projection 232 serves to facilitate the generation of the rotational flow of the air in the casing 3.

In the present embodiment, the balance control structure is provided by the cutout portion A formed on a part of the main-wall second projection 232, as shown in FIG. 10. For example, the cutout portion A is provided by partly recessing a radially outer end of the main-wall second projection 232. In this case, since the balance control structure is provided without forming the cutout portions on the blades 21, which serve to force the air out, it is less likely that the air-blowing efficiency will be reduced and the noise will be increased due to the balance control structure.

The balance control structure is provided by using the main-wall second projection 232 that is provided for facilitating the generation of the rotational flow in the casing 3. It is easy to control the balance without largely changing the shape of the fan 2 and the like.

Sixth Embodiment

Figure 11:
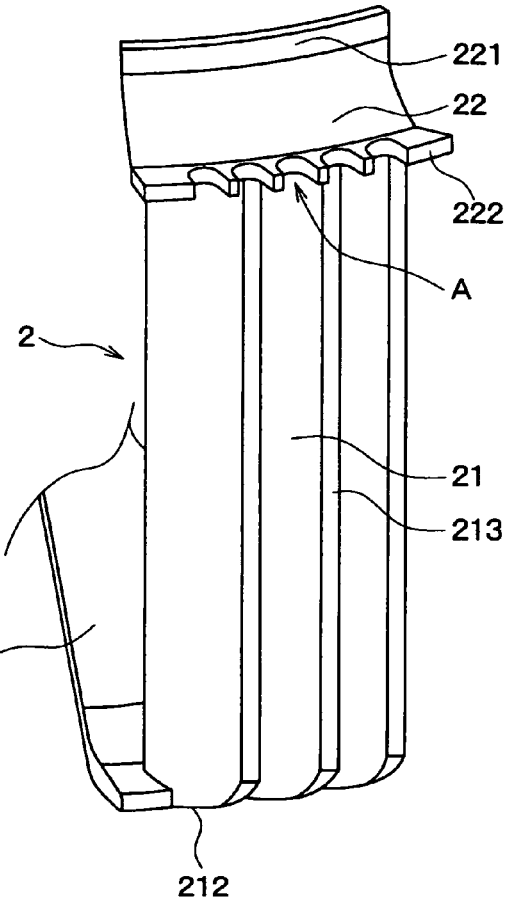
FIG. 11 is a perspective view of a part of a centrifugal fan according to a sixth embodiment of the present invention.

Referring to FIG. 11, in the present embodiment, the balance control structure is provided by multiple cutout portions A formed on the side-wall second projection 222.

The side-wall second projection 222 has the plural cutout portions A, each having a semi-circular shape, for example. The cutout portions A are disposed adjacent to each other in a circumferential direction of the fan 2. For example, the cutout portions A are arranged continuously in the circumferential direction, such that the part of the side-wall second projection 222 has a serrated portion.

The air separating from the side wall 22 after flowing through the vicinity of the side wall 22 is likely to be disturbed, that is, cause wake turbulence. In the case where the cutout portions A are arranged adjacent to each other in the circumferential direction, the cutout portions A serves as a serration that restricts generation of the wake turbulence of the air separated from the side wall 22. Therefore, noise of the fan 2 is reduced.

Here, the shape of the cutout portions A is not limited to the semi-circular shape. The cutout portions A can have any other shapes, such as V-shape, U-shape and edged U-shape and the like.

Seventh Embodiment

Figure 12:
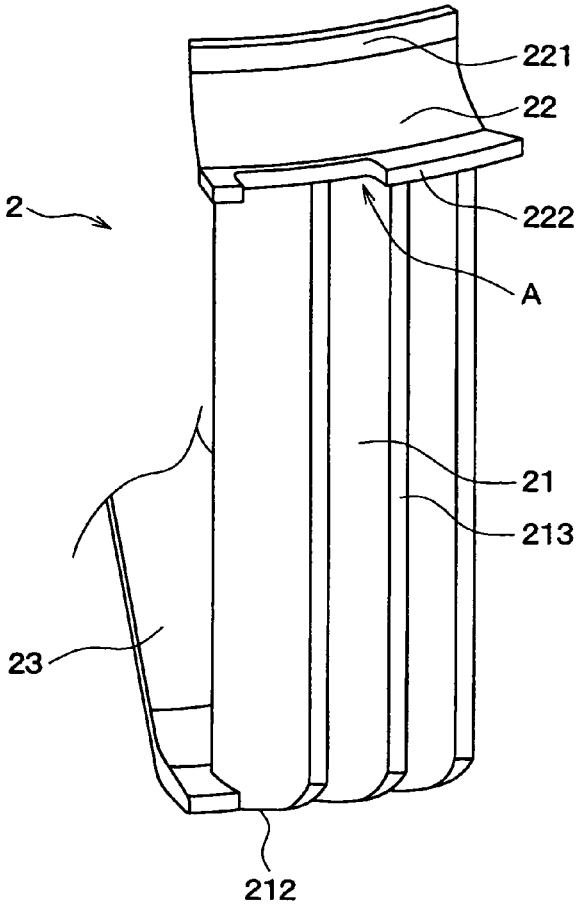
FIG. 12 is a perspective view of a part of a centrifugal fan according to a seventh embodiment of the present invention.
Figure 13:
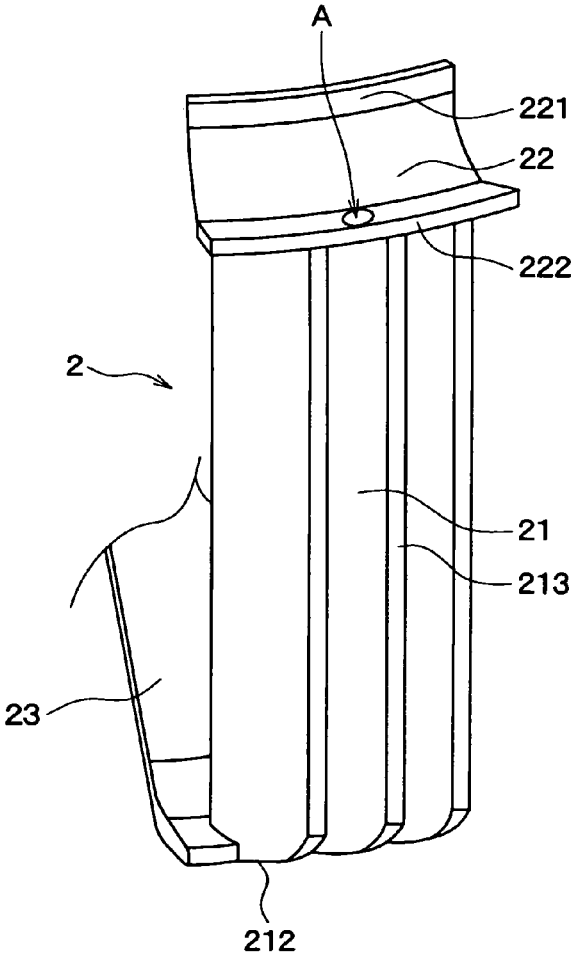
FIG. 13 is a perspective view of a part of a centrifugal fan according to an eighth embodiment of the present invention.

Referring to FIG. 12, in the present embodiment, the balance control structure is provided by the cutout portion A formed on the part of the side-wall second projection 222. The cutout portion A has a shape different from that of the second embodiment shown in FIG. 4.

In a case where it is necessary to increase the size of the cutout portion to control the balance, the length of the cutout portion A in the circumferential direction can be increased. For example, the cutout portion A can have a shape that the length in the circumferential direction is larger than a depth in the radial direction.

Eighth Embodiment

Referring to FIG. 8, in the present embodiment, the balance control structure is provided by the cutout portion A formed on the part of the side-wall second projection 222. The cutout portion A has a shape different from that of the second embodiment shown in FIG. 4.

In the second embodiment, the cutout portion A is formed by recessing the radially outer edge of the side-wall second projection 222. In the present embodiment, on the other hand, the cutout portion A is formed as an opening or a through hole, as shown in FIG. 8.

Ninth Embodiment

Figure 14:
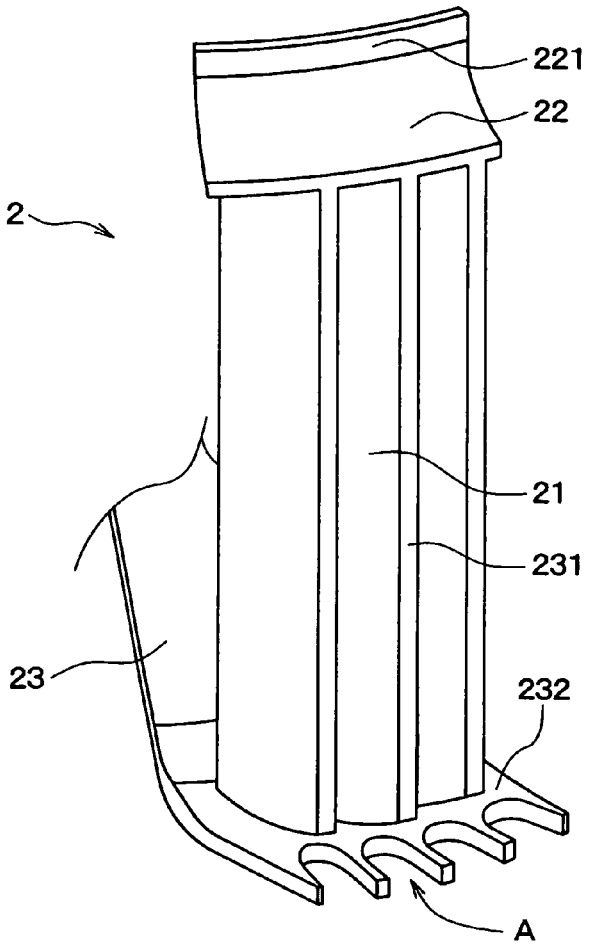
FIG. 14 is a perspective view of a part of a centrifugal fan according to a ninth embodiment of the present invention.

Referring to FIG. 14, in the present embodiment, the balance control structure is provided by multiple cutout portions A formed on the main-wall second projection 232.

The cutout portions A are arranged along the radially outer edge of the main-wall second projection 232, and adjacent to each other in the circumferential direction. For example, the cutout portions A have the semi-circular shape. The cutout portions A can be arranged continuously in the circumferential direction as the serrated portion.

The air separated from the main wall 23 after flowing through the vicinity of the main wall 23 is likely to be disturbed and cause the wake turbulence. In the case where the cutout portions A are arranged adjacent to each other in the circumferential direction, the cutout portions A serve as the serration that restricts the wake turbulence of the air separated from the main wall 23. As such, the noise is reduced.

Here, the shape of the cutout portions A is not limited to the semi-circular shape. The cutout portions A can have any other shapes such as V-shape, U-shape, edged U-shape and the like.

Tenth Embodiment

Figure 15:
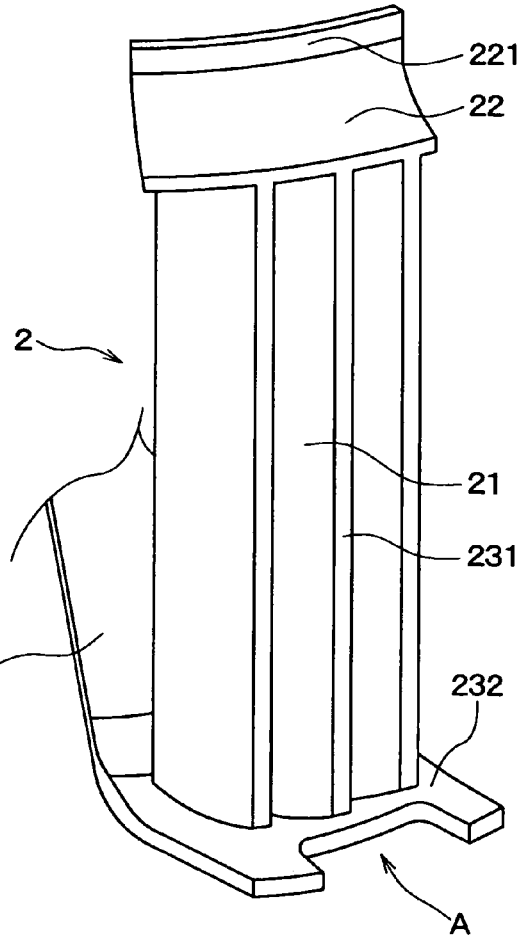
FIG. 15 is a perspective view of a part of a centrifugal fan according to a tenth embodiment of the present invention.

Referring to FIG. 15, in the present embodiment, the balance control structure is provided by the cutout portion A formed on the part of the main-wall second projection 232. The cutout portion A has a shape, such as, a size, different from that of the fifth embodiment shown in FIG. 10.

In the case where it is necessary to increase the side of the cutout portion A to control the balance, the length of the cutout portion A in the circumferential direction can be increased. For example, the cutout portion A can have a shape that the length in the circumferential direction is greater than the depth in the radial direction.

In the above embodiments, the cutout portion A is provided by the recess, the opening, the through hole and the like. The cutout portion A can be formed by various methods. For example, the cutout portion A can be formed when the fan 2 is molded. As another example, the cutout portion A can be formed by removing a part of the fan 2 other than the blades 21, such as by cutting, punching or the like.

Exemplary embodiments of the present embodiment are described above as the first to tenth embodiments. However, the above embodiments can be employed in various combinations. For example, the size, the shape and/or number of the cutout portion A of the side-wall first projection 221 shown in FIG. 2 can be modified as the ways shown in FIGS. 11, 12 and/or 13.

Additional advantages and modifications will readily occur to those skilled in the art. The invention in its broader term is therefore not limited to the specific details, representative apparatus, and illustrative examples shown and described.

What is claimed is:

1. A centrifugal fan comprising:

a plurality of blades;

a first wall disposed at first axial ends of the blades; and a second wall disposed at second axial ends of the blades and having a shaft portion at a center, wherein the first wall is provided with a cutout portion configured to control balance; and the first wall includes a projection that projects from radially outer edges of the blades in a radially outward direction and has an annular shape, and the cutout portion is formed on the projection.

2. The centrifugal fan according to claim 1, wherein the first wall has a plurality of cutout portions including the cutout portion, and the plurality of cutout portions is adjacent to each other in a circumferential direction of the first wall.

3. The centrifugal fan according to claim 1, wherein the cutout portion has a first dimension in a circumferential direction of the first wall and a second dimension in a radial direction, and the first dimension is greater than the second dimension.

4. The centrifugal fan according to claim 1, wherein the cutout portion is provided by a through hole formed on the first wall.

5. The centrifugal fan according to claim 1, wherein the cutout portion is provided by removing a part of the first wall.

6. A centrifugal fan comprising:

a plurality of blades;

a first wall disposed at first axial ends of the blades; and a second wall disposed at second axial ends of the blades and having a shaft portion at a center, wherein the first wall is provided with a cutout portion configured to control balance; and the first wall includes a projection that projects from the first axial ends of the blades in an axially outward direction and has an annular shape, and the cutout portion is formed on the projection.

7. A blower comprising:

a centrifugal fan including a plurality of blades, a first wall disposed at first axial ends of the blades and defining a suction port for suctioning air, and a second wall disposed at second axial ends of the blades and having a shaft portion at a center;

a casing that houses the centrifugal fan and defines an air passage on a radially outer side of the centrifugal fan; and an electric motor having a rotation shaft coupled to the shaft portion of the centrifugal fan, wherein the centrifugal fan further includes a cutout portion configured to control balance, the cutout portion is formed on at least one of the first wall and the second wall;

the casing has a bell mouth portion defining a suction port;

the first wall has a projection that projects from the first axial ends of the blades and is adjoined with the bell mouth portion such that a maze-shaped clearance is provided between the casing and the first wall, and the cutout portion is formed on the projection.

8. The blower according to claim 7, wherein the cutout portion is provided by removing at least one of a part of the first wall and a part of the second wall.

9. A blower comprising:

a centrifugal fan including a plurality of blades, a first wall disposed at first axial ends of the blades and defining a suction port for suctioning air, and a second wall disposed at second axial ends of the blades and having a shaft portion at a center;

a casing that houses the centrifugal fan and defines an air passage on a radially outer side of the centrifugal fan; and an electric motor having a rotation shaft coupled to the shaft portion of the centrifugal fan, wherein the centrifugal fan further includes a cutout portion configured to control balance, the cutout portion is formed on at least one of the first wall and the second wall;

the first wall has a projection that projects from radially outer ends of the blades into the air passage and has an annular shape, and the cutout portion is formed on the projection.

10. A blower comprising:

a centrifugal fan including a plurality of blades, a first wall disposed at first axial ends of the blades and defining a suction port for suctioning air, and a second wall disposed at second axial ends of the blades and having a shaft portion at a center;

a casing that houses the centrifugal fan and defines an air passage on a radially outer side of the centrifugal fan; and an electric motor having a rotation shaft coupled to the shaft portion of the centrifugal fan, wherein the centrifugal fan further includes a cutout portion configured to control balance, the cutout portion is formed on at least one of the first wall and the second wall;

the casing has a casing projection projecting toward the centrifugal fan, the second wall of the centrifugal fan has a projection projecting in the axial direction and is adjoined with the casing projection such that a maze-shaped clearance is provided between the casing and the second wall, and the cutout portion is formed on the projection.

* * * * *